US005574700A

United States Patent [19]

Chapman

[11] Patent Number: 5,574,700

[45] Date of Patent: Nov. 12, 1996

[54] RATCHET OPERATED KICK-UP BRACKET

[75] Inventor: Brian R. Chapman, Broken Arrow, Okla.

[73] Assignee: Lowrance Electronics, Inc., Tulsa, Okla.

[21] Appl. No.: 573,665

[22] Filed: Dec. 18, 1995

[51] Int. Cl.[6] ..... H04R 17/00

[52] U.S. Cl. ..... 367/173

[58] Field of Search ..... 367/173, 165

[56] References Cited

U.S. PATENT DOCUMENTS

| | | | |
|---|---|---|---|
| 2,316,436 | 4/1943 | Kalter . | |
| 3,521,225 | 7/1970 | Kursman et al. . | |
| 3,729,162 | 4/1973 | Salvato . | |
| 4,850,559 | 7/1989 | Boucher | 367/173 |
| 4,907,208 | 3/1990 | Lowrance et al. | 367/165 |
| 5,109.364 | 4/1992 | Stiner | 367/173 |
| 5,142,497 | 8/1992 | Warrow | 367/173 |

*Primary Examiner*—Daniel T. Pihulic
*Attorney, Agent, or Firm*—Bell, Seltzer, Park & Gibson, P.A.

[57] ABSTRACT

A mounting apparatus for mounting a sonar transducer assembly to an aquatic vehicle, particularly for fish finding and mapping devices. The mounting apparatus permits the transducer assembly, typically extending beneath the hull of a boat, to "kick-up" when contacted by a predetermined force such as when colliding with an underwater obstacle. The mounting apparatus includes a mounting member including a ratchet surface for matingly engaging a complimentary ratchet surface of the transducer assembly. The ratchet surfaces will give way upon contact with sufficient force permitting the transducer assembly to pivot upwardly and rearwardly to protect the transducer and prevent it from being sheared from the aquatic vehicle.

21 Claims, 2 Drawing Sheets

RATCHET OPERATED KICK-UP BRACKET

FIELD OF THE INVENTION

The present invention relates to a protective mounting for mounting a sonar transducer assembly to an aquatic vehicle.

BACKGROUND OF THE INVENTION

High-frequency, transistorized sonar are used in the marine industry to detect and display objects beneath an aquatic vehicle. This technology is useful in all facets of the marine industry including mapping and fish-finding. The present invention has numerous applications in the marine industry, but will be described particularly for fish-finding devices used by the recreational angler.

Sonar transducer assemblies for fish-finding, in general, are attached to the hull of a boat and are positioned to direct the sonar below the boat to accurately transmit and receive acoustic signals. Thus, the transducer assembly is generally positioned to extend below the hull of the boat. Because of its positioning, the transducer assembly is often subject to collide with underwater obstacles, thereby rendering it susceptible to damage or shearing from the boat's hull. To avoid damage or destruction to the assembly, and appended costs involved, it is important to provide means to protect the transducer assembly.

"Kick-up" brackets have been developed which permit upward and rearward rotation of the transducer assembly to reposition the transducer assembly upon contact with an underwater obstacle. These brackets must provide a sturdy mechanical connection when the transducer is in an operative position, i.e., extending beneath the hull of the boat, yet readily permit pivotal movement of the transducer housing upon contact with significant force. The pivotal movement, however, must be restricted until contacted with substantial force. For instance, the transducer assembly will be inoperative at high speeds if the kick-up action results from forces due merely to drag at high speeds. Some prior art devices meet these objectives, but do not produce several of the additional advantages of the present invention. Other prior art devices, however, although effective for their intended purposes, often include structures which inherently are more difficult to fabricate, assemble and repair.

An example of a "kick-up" bracket for sonar transducers mounted to the hull of a boat is U.S. Pat. No. 5,109,364 to Stiner. That patent sets forth a sonar transducer assembly which is retained in an operative position by a snap-fit connection. The snap-fit is provided by interlocking members on the mounting member and the transducer housing, respectively. Thus, upon significant force, the interlocking members may be disengaged to permit pivotal movement of the transducer housing. Another example is U.S. Pat. No. 4,907,208 to Lowrance et al. That patent sets forth a sonar transducer that is mounted to a bracket utilizing lockwashers. The lockwashers act as a clutch to maintain the transducer in a stationary position but which give way to release the connection permitting the transducer assembly to pivot upwardly and rearwardly.

Other prior art connections permitting "kick-up" action are magnetic connections, as set forth in U.S. Pat. No. 5,142,497 to Warrow, and spring biased connections as set forth in U.S. Pat. No. 4,850,559 to Boucher and U.S. Pat. No. 3,729,162 to Salvato. The more complex the assembly, however, the more difficult it is to fabricate, assemble, and repair, thereby making it more costly to the consumer, e.g., the recreational angler.

SUMMARY OF THE INVENTION

It is therefore an object of the present invention to provide a kick-up bracket which prevents the transducer from being damaged or sheared when contacting an underwater obstacle.

It is also an object of the present invention to maintain the transducer assembly in an operative position under normal conditions, even under forces due to drag caused by high speed boats It is a further object of the present invention to provide a mounting for a sonar transducer which is easily manufactured and inexpensive to the angler.

It is yet another object of the present invention to provide a mounting for a sonar transducer which may readily be repositioned after pivoting out of the way of an underwater obstacle.

It is a final object of the present invention to provide an adjustable mounting for a sonar transducer wherein the transducer may be positioned at various angles to the aquatic vehicle.

These and other objects are achieved by the present invention which provides a transducer assembly for mounting a sonar transducer to the hull of a boat utilizing a "kick-up" mounting. The present transducer mounting assembly includes a mounting member for mounting a transducer assembly to the hull or transom of an aquatic vehicle. The mounting member includes at least one mounting arm wherein at least a portion of the mounting arm includes an irregular engagement surface having a first predetermined shape. The mounting assembly also includes a spacer connected to the transducer assembly for connecting the transducer assembly to the mounting member be providing a complimentary engagement surface having a second predetermined shape which corresponds to the first predetermined shape of the mounting arm. This arrangement permits the spacer to mate in a facing relationship with the engagement surface of the mounting arm such that the spacer and mounting arm interlock to fixedly mount the transducer assembly to the aquatic vehicle in an operative position. In a preferred embodiment, the complimentary engagement surfaces of the spacer and the mounting arm are ratchet configurations, each with plural ratchet teeth.

This arrangement also permits relative movement between the complimentary engagement surfaces of each of the spacer and mounting arm upon contact of the transducer assembly with at least a predetermined force such that the transducer assembly may pivot to a second position to thereby protect the transducer assembly. In a preferred embodiment, this is achieved, in part, by the providing a U-shaped mounting bracket and positioning the spacer therein. On outside surfaces of the bracket are positioned compressible washers to cooperate with the mounting bracket which is at least partially elastic. This permits horizontal elongation of the bracket to permit relative rotational movement between the ratchet teeth of the spacer and mounting arms upon exposure to substantial force. Therefore, the transducer assembly can pivot to the second position to avoid damage.

BRIEF DESCRIPTION OF THE DRAWINGS

The foregoing and other objects, features, and advantages of the present invention will be made apparent from the following detailed description of the preferred embodiment of the invention and from the drawings, in which.

DETAILED DESCRIPTION OF THE PREFERRED EMBODIMENTS

The present invention will now be described more fully in detail with reference to the accompanying drawings, in which the preferred embodiments of the invention are shown. This invention should not, however, be construed as limited to the embodiments set forth herein; rather, they are provided so that this disclosure will be thorough and complete and will fully convey the scope of the invention to those skilled in the art.

Figure 1:
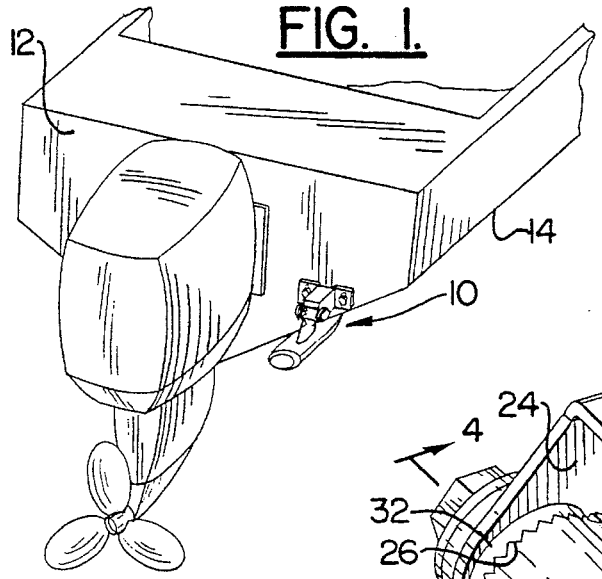
FIG. 1 is an environmental view of the transducer arrangement of the present invention as it is mounted to an aquatic vehicle.

The transducer assembly, shown generally at 10, according to the present invention, is mounted to an aquatic vehicle such as a boat 12. As illustrated in FIG. 1, the transducer arrangement 10 may be positioned so that it extends beneath the hull 14 of the boat 12. While the transducer arrangement 10 may be positioned anywhere upon the boat 12, in the preferred embodiment, it is positioned on the rear of the boat as illustrated in FIG. 1.

Figure 2:
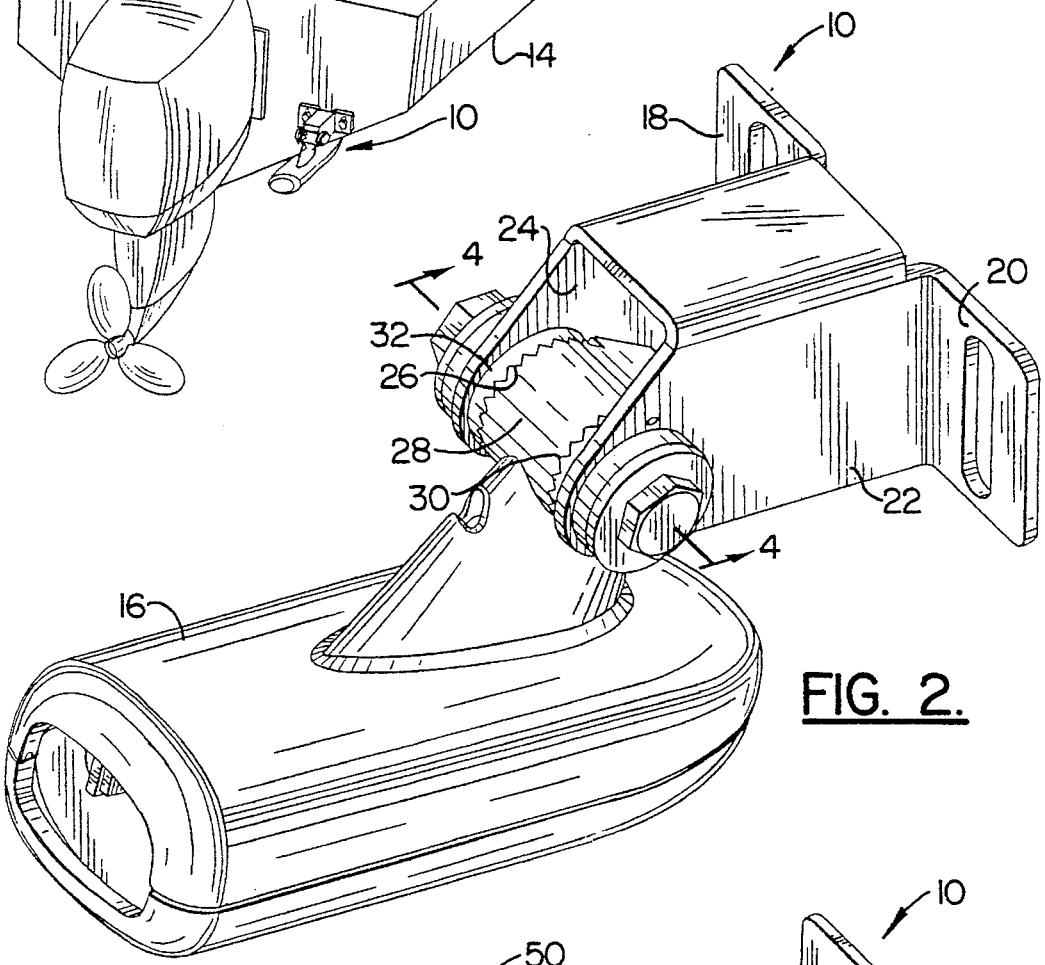
FIG. 2 is a side perspective view of the transducer arrangement according to the present invention.

FIG. 2 is a perspective view of the transducer arrangement 10 including at least one sonar transducer (not shown) positioned with a transducer assembly 16. Any number of sonar transducers may be positioned within the transducer assembly 16 without departing from the spirit and scope of the invention.

The transducer arrangement 10 also includes a mounting member shown generally at 18 for mounting the transducer assembly 16 to the aquatic vehicle. The mounting member includes a mounting bracket 20 for securing the mounting member 18 and transducer assembly 16 to the aquatic vehicle 12. The mounting member also includes a transducer assembly bracket 22 defined substantially be at least one mounting arm 24. In the preferred embodiment, the transducer assembly bracket 22 is substantially defined by a U-shaped bracket when viewed from the front of the transducer arrangement 10. As such, the transducer assembly bracket 22 comprises two mounting arms 24, in the preferred embodiment. Positioned along a surface of the mounting arm 24 is an irregular engagement surface 26 having a first predetermined shape.

The transducer arrangement 10, according to the present invention, also includes a spacer 28 associated with the transducer assembly 16 for attaching the transducer assembly 16 to the assembly bracket 22 of the mounting member 18. The spacer 28, in the preferred embodiment, is substantially defined by at least one mating surface 30 comprising a complimentary engagement surface having a second predetermined shape which corresponds to the first predetermined shape 26 of the mounting arm 24. In the preferred embodiment, the spacer 28 comprises at least two opposing surfaces 30, each comprising a complementary engagement surface and wherein the spacer 28 is positioned within the U-shaped mounting bracket 20 between the mounting arms 24 as illustrated in FIG. 2. With this arrangement, the irregular surface 26 of the transducer assembly bracket 22 and the complementary engagement surface 30 of the spacer 28 are positioned to meet in a facing relationship with one another. The complementary engagement surfaces 26 and 30 are illustrated in FIG. 2 in an interlocking position wherein the transducer assembly is fixedly mounted in a first operative position.

In the preferred embodiment, the complementary engagement surfaces 26 and 30 are each ratchet members comprising a plurality of mating teeth. In a further preferred embodiment, the engagement surface 26 of the mounting arm 24 is provided in the form of a ratchet disk 32 as illustrated in FIG. 2. In this embodiment, the engagement surface 26 is thereby provided as a discrete element separately formed from the mounting arm 24. However, it is within the spirit and scope of this invention to provide the engagement surface 26 of the mounting arm 24 integral therewith.

Figure 3:
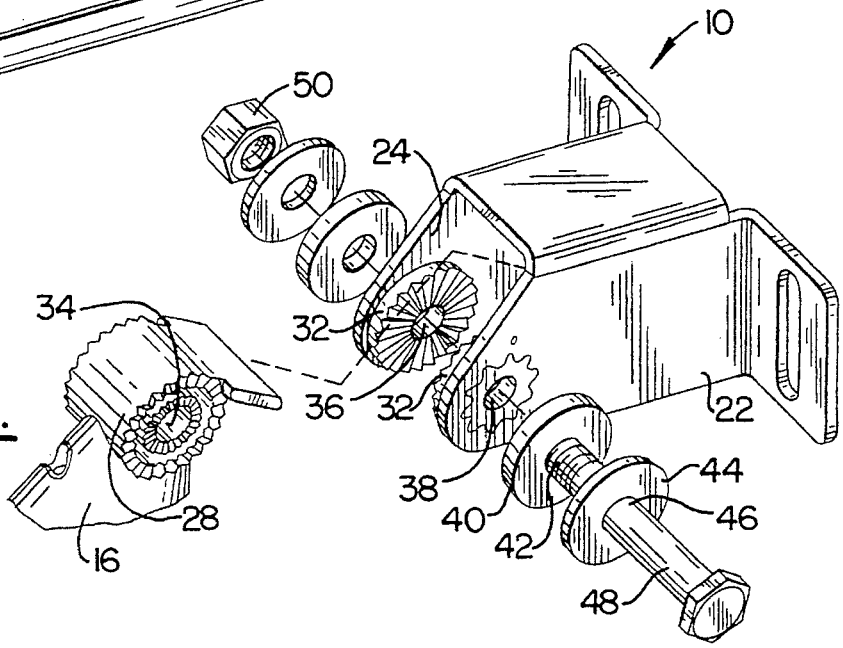
FIG. 3 is an exploded view of the mounting apparatus according to the present invention.

FIG. 3 illustrates an exploded view of the transducer arrangement 10 according to the present invention. This view illustrates a preferred embodiment wherein the transducer assembly bracket 22 is U-shaped with two mounting arms 24. Positioned between the mounting arms 24 is the spacer 28 connected to the transducer assembly 16. Positioned between the spacer 28 and the mounting arms 24 are the ratchet disks 32, each carrying the engagement surface 26 in the form of a ratchet member comprising a plurality of teeth. The spacer 28 comprises a lengthwise extending aperture 34 which is correspondingly positioned with an opening 36 defined by each of the ratchet disks 32. These openings are correspondingly aligned with openings 38 defined by each of the mounting arms 24 of the transducer assembly bracket 22.

Positioned against the outer surfaces of each of the mounting arms 24 are compressible washers or biasing members 40, each defining an opening 42. In the preferred embodiment, further washers 44 are provided also defining openings 46. Each of the openings or apertures 46, 42, 38, 36, and 34 are positioned in alignment such that a connecting member 48 may be inserted therethrough for securing the transducer assembly 16 to the mounting arms 24 of the assembly bracket 22.

Figure 4:
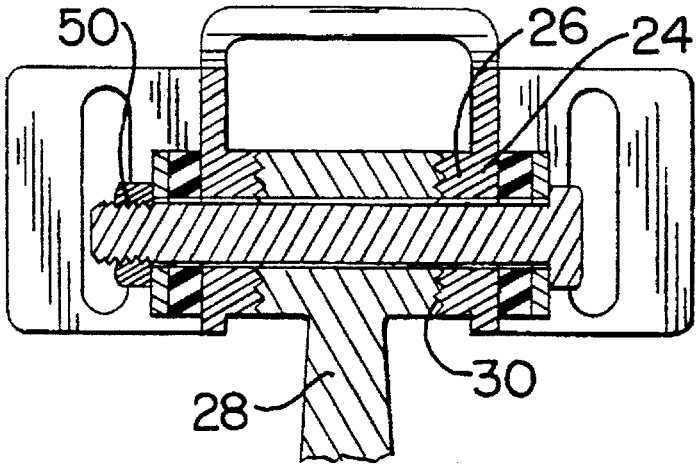
FIG. 4 is a cross-sectional view of the mounting apparatus taken at line 4—4 of FIG. 2.

The connecting member 48 is secured by a nut 50. Thus, the nut 50 may be tightened to secure the various parts illustrated in FIG. 3 snugly together. As illustrated in FIG. 4, the nut 50 threadably engages the connecting member 48. When properly positioned, the ratchet teeth of the engagement surface 26 of the mounting arm 24 and the complementary engagement surface 30 of the spacer 28 will mate with one another to form a secure frictional fit.

The secure frictional fit is best illustrated in the cross-sectional view of FIG. 4 taken at line 4—4 of FIG. 2. In this view, it is apparent that the engagement surface 26 of the mounting arm 24, matingly engages the complementary engagement surface 30 of the spacer 38. Thus, the complementary engagement surfaces 26 and 30 provide a secure connection securing the transducer assembly 16 in a first operative position wherein the transducer assembly 16 extends beneath the hull 14 of the boat 12. The connection produced by the complementary engagement surfaces 26 and 30 maintains the transducer assembly 16 in the operative position even when the transducer assembly 16 is exposed to significant forces such as drag forces caused by a high speed boat 12. The assembly 10 according to the present invention enables the transducer assembly to be secured in various operative positions. The transducer assembly 16 may be rotated to a selected operative position by loosening the nut 50, selecting a position by rotating manually the transducer assembly 16, and then tightening the nut 50.

However, if the transducer assembly 16 comes into contact with a predetermined force, the complementary engagement surfaces 26 and 30 permit the transducer assembly 16 to pivot rearwardly and upwardly to avoid damage or being sheared off, even when the nut 50 is securely fit to the connecting member 48. The predetermined force causing the pivotal movement between the complementary engagement surfaces 26 and is substantially less than the force required to shear the transducer assembly 16 from the transducer assembly bracket 22. The ratchet arrangement of the present invention retains the transducer assembly 16 in its pivoted second position until it is repositioned.

In the preferred embodiment, the U-shaped mounting bracket 22 is at least partially elastic to permit the mounting arms 24 to horizontally expand outward when the transducer assembly 16 is contacted by the predetermined amount of force. In the preferred embodiment, the mounting bracket 22 is formed of stainless steel. Other materials containing an inherent degree of elasticity may also be utilized to form the transducer assembly bracket 22 without departing from the scope of the present invention.

Moreover, a non-unitary structure may be provided in place of the transducer assembly bracket 22 wherein only the downward extending arms 24 are provided of an elastic material. Also in the preferred embodiment, the material used to form the ratchet disks 32 and/or the engagement surface 26 of the mounting arms 24 is formed of a material possessing substantially the same strength as the material used to form the complementary engagement surfaces 30 of the spacer 28. In a preferred embodiment, each of these materials is the same, and each is formed of injection molded ABS (acrylonitrile butadiene styrene resin). Although other materials may be selected to form these portions, ABS both provides the adequate amount of strength, elasticity, and is readily available, cost-effective, and easy to fabricate. Thus, any wear experienced by either the complementary engagement surfaces 26 and 30 will occur substantially equally to each of the mounting arms 24 and the spacer 28.

In the preferred embodiment, the washers 40 are compressible and are formed of rubber. The compressible rubber washers 40 permit linear expansion of the mounting arms 24 of the transducer assembly bracket 22 along the direction of the connection member 48 while acting as a biasing member to secure the assembly 10.

The transducer assembly 16 will be maintained in its operative position until it comes into contact with a predetermined amount of force to cause the complementary engagement surfaces 26 and 30 to experience relative pivotal movement therebetween. The predetermined force may be adjusted by the degree the nut 50 is threadably engaged with the connecting member 48. For example, in the preferred embodiment, the nut 50 will be secured upon the connecting member 48 such that the transducer assembly 16 will produce a 40-lb drag force when, for example, the boat 12 is being driven at 80 mph (a typical high speed fast boat). With this adjustment, the high speed operation of the boat 12 will not cause an inadvertent kick-up of the transducer assembly 16. Moreover, at these forces, the compressible washers or biasing members 40 exert substantial bias against the mounting arms 24 to maintain them in a non-expanded position.

Figure 5:
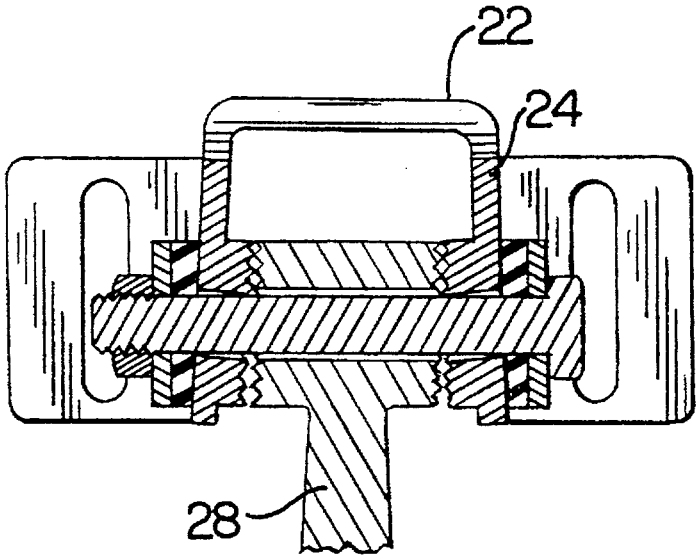
FIG. 5 is a cross-sectional view of the mounting apparatus of FIG. 4 shown in a pivoted position.

However, when more than the predetermined force contacts the transducer assembly 16, the transducer arrangement 10, according to the present invention, permits the transducer assembly 16 to pivot rearwardly and upwardly to avoid damaging or even shearing off of the transducer assembly 16. This pivotal movement is illustrated in FIG. 5. As shown in FIG. 5, the transducer assembly 16 is permitted to pivot because, upon contact of the predetermined force against the transducer assembly 16, the mounting arms 24 of the transducer assembly bracket 22 experience horizontal, linear expansion due to the elasticity of its material wherein the complementary engagement surfaces 26 and 30, each comprising a plurality of ratchet teeth, are positioned such that the teeth are positioned point-to-point as opposed to being positioned in the interlocking arrangement shown in FIG. 4. The mounting arms 24 permit it to linearly expand because the washers 40 are formed of a compressible material. Once the transducer assembly 16 has been pivoted away from damage of an underwater obstacle, the compressive forces of the washers 40 will again urge the mounting arms 24 wherein the engagement surfaces 26 and 30 will again be interlocking and will maintain the transducer assembly 16 in a second, inoperative position.

To reposition the transducer assembly to the first operative position, the nut 50 may be removed from the connecting member 48 and the transducer assembly 16 may be repositioned in the operative position. In a preferred embodiment, as stated above, each of the complementary engagement surfaces 26 and 30 are formed of an injection molded ABS. As such, the ratchet teeth of these members will not be sheared during the pivotal movement. In an alternative embodiment, however, the material of either the spacer 28 or the engagement surface 26 of the mounting arm 24 may be provided of a less study, or weaker material than the complimentary surface wherein the ratchet teeth of one will compress and the ratchet teeth of the other will remain stable. Alternatively, although less desirably, some or all of the ratchet teeth of one of the members may break off.

While particular embodiments of the invention have been described, it will understood, of course, the invention is not limited thereto, since modifications may be made to those skilled in the art, particularly in light of the foregoing teachings. It is, therefore, contemplated by the appended claims to cover any such modifications that incorporate those features or these improvements in the true spirit and scope of the invention.

That which is claimed is:

1. A mounting apparatus for mounting a transducer assembly to an aquatic vehicle comprising:

a mounting member for mounting the transducer assembly to the aquatic vehicle, said mounting member comprising at least one mounting arm wherein at least a portion of said at least one mounting arm comprises an irregular engagement surface having a first predetermined shape; and a spacer connected to the transducer assembly for connecting the transducer assembly to said mounting member, said spacer comprising a complimentary engagement surface having a second predetermined shape which corresponds to the first predetermined shape of said mounting arm, wherein said spacer is adapted to mate in a facing relationship with said engagement surface of said mounting arm such that said spacer and said mounting arm of said mounting member interlock to fixedly mount the transducer assembly to the aquatic vehicle in a first operative position, and wherein the mounting apparatus is adapted to permit relative movement between said engagement surfaces of each of said spacer and mounting arm upon contact of the transducer assembly with at least a predetermined force such that the transducer assembly pivots to a second position to thereby at least partially protect the transducer assembly.

2. A mounting apparatus according to claim 1 wherein said mounting member is substantially U-shaped and comprises two spaced apart mounting arms, and wherein said spacer is disposed between said mounting arms.

3. A mounting apparatus according to claim 2 wherein said spacer is substantially cylindrical and comprises two opposing ends having respective complimentary engagement surfaces, and wherein each of said mounting arms possesses said respective engagement surfaces such that said spacer can be interlocked between said mounting arms.

4. A mounting apparatus according to claim 1 wherein said complimentary engagement surfaces of said spacer and said mounting arm are ratchet surfaces comprising plural teeth for mating engagement.

5. A mounting apparatus according to claim 4 wherein each of said mounting arms comprises a ratchet disks defining the engagement surface, said ratchet disks each being positioned in a facing relationship with said ratchet surface of said spacer.

6. A mounting apparatus according to claim 4 wherein said ratchet surface of said spacer is formed of a first material and said ratchet surface of said mounting arm is formed of a second material wherein said first and second materials comprise substantially different mechanical strengths such that relative movement between said spacer and said mounting arm is permitted under said predetermined force to permit the transducer assembly to pivot from the first operative position to the second position.

7. A mounting apparatus according to claim 1 wherein said mounting arm comprises a predetermined amount of elasticity to permit said transducer assembly to pivot to said second position.

8. A mounting apparatus according to claim 7 further comprising a biasing member for biasing said mounting arm in an engaging relationship with said spacer.

9. A mounting apparatus according to claim 8 wherein said ratchet disk is formed of a first material and said ratchet surface of said spacer is formed of a second material, said first and second materials each having substantially equal strength wherein said first and second materials are selected to permit said transducer assembly to pivot to the second position.

10. A mounting apparatus according to claim 2 wherein each of said mounting arms defines an aperture, and said spacer defines a lengthwise extending opening therethrough, said spacer being disposed between said mounting arms such that the lengthwise extending aperture is aligned with the apertures defined by said mounting arms.

11. A mounting apparatus according to claim 10 further comprising:

at least two biasing members each defining apertures therethrough, said washers being positioned said mounting arms of said mounting member; and a connecting member extending through the lengthwise extending opening of said spacer, and said apertures of said mounting arms and said washers for securing said mounting apparatus together.

12. A mounting apparatus according to claim 11 wherein said biasing members are substantially compressible and said mounting bracket is at least partially elastic to thereby permit relative rotational movement between said spacer and said mounting arms upon application of at least the predetermined force such that the transducer assembly can pivot to the second position.

13. A transducer arrangement for an aquatic vehicle comprising:

a sonar transducer positioned within a transducer assembly;

a mounting member for mounting the transducer assembly to the aquatic vehicle, said mounting member defined by a mounting bracket for securing said mounting member to the aquatic vehicle and a transducer assembly bracket defined substantially by at least one mounting arm, said arm comprising an irregular engagement surface having a first predetermined shape;

a spacer associated with said transducer assembly for attaching said transducer assembly to said assembly bracket of said mounting member, said spacer being substantially defined by at least one mating surface comprising a complimentary engagement surface having a second predetermined shape which corresponds to the first predetermined shape of said mounting arm;

wherein said engagement surface of said mounting arm and said complimentary engagement surface of said spacer are arranged to mate in a facing relationship with one another such that said transducer assembly is fixedly mounted in a first operative position and wherein the mounting member is adapted to pivot to a second position upon contact of the transducer assembly with at least a predetermined force.

14. A transducer arrangement according to claim 13 wherein said predetermined force is substantially less than a force required to shear said transducer assembly from said mounting arm.

15. A transducer arrangement according to claim 13 wherein said transducer bracket is substantially U-shaped and comprises at least two mounting arms each comprising said irregular surface portion and said spacer comprises at least two opposing surfaces each comprising said complimentary engagement surface wherein said spacer is disposed between said mounting arms and said irregular surface of said transducer bracket and said complimentary engagement surface of said spacer are positioned to mate in a facing relationship with one another.

16. A transducer arrangement according to claim 15 wherein said complimentary engagement surfaces of said spacer and said irregular surface of said arms of the transducer bracket are ratchet members.

17. A transducer arrangement according to claim 16 further comprising at least two ratchet disks each positioned adjacent said mounting arms of said transducer bracket, said disks comprising said irregular surface portions of said vertical arms.

18. A transducer arrangement according to claim 17 wherein said ratchet disks and said ratchet surfaces of said spacer are each formed of material having substantially the same degree of mechanical strength to permit relative rotational movement therebetween when said transducer assembly pivots to said second position.

19. A transducer arrangement according to claim 17 wherein said spacer defines a lengthwise extending aperture, said ratchet disks each define an opening, and said mounting arms each define an opening, said mounting arm further comprising at least two biasing members each positioned on outside surfaces of each of said mounting arms, said biasing members each defining an opening and said transducer arrangement further comprising a connecting member extending through said axial aperture of said spacer and said openings of said ratchet disks, mounting arms, and washers for securing the transducer assembly to the mounting member.

20. A transducer assembly according to claim 19 wherein said biasing members are compressible.

21. A transducer assembly according to claim 20 wherein said mounting bracket comprises at least partial elasticity.

* * * * *

UNITED STATES PATENT AND TRADEMARK OFFICE

CERTIFICATE OF CORRECTION

PATENT NO. : 5,574,700

DATED : November 12, 1996

INVENTOR(S) : Chapman

It is certified that error appears in the above-identified patent and that said Letters Patent is hereby corrected as shown below:

Column 5, line 11, after "and" insert --30--.

Signed and Sealed this

Twelfth Day of August, 1997

Bruce Lehman

*Attest:*

BRUCE LEHMAN

*Attesting Officer*

*Commissioner of Patents and Trademarks*